US007531292B2

(12) United States Patent
Thomas

(10) Patent No.: US 7,531,292 B2
(45) Date of Patent: May 12, 2009

(54) METHOD FOR PRODUCING DISC OVERLAY PROOFS

(75) Inventor: Keith Thomas, Weaverville, NC (US)

(73) Assignee: Arvato Digital Services LLC, Weaverville, NC (US)

( * ) Notice: Subject to any disclaimer, the term of this patent is extended or adjusted under 35 U.S.C. 154(b) by 611 days.

(21) Appl. No.: 11/227,924

(22) Filed: Sep. 15, 2005

(65) Prior Publication Data

US 2007/0062388 A1 Mar. 22, 2007

(51) Int. Cl.
*G03C 5/00* (2006.01)

(52) U.S. Cl. ..... 430/293; 430/292

(58) Field of Classification Search ..... 430/292–293; 400/693

See application file for complete search history.

(56) References Cited

U.S. PATENT DOCUMENTS 6,893,176 B2 * 5/2005 Obara ..... 400/693
2004/0081915 A1 * 4/2004 Andrews ..... 430/293

OTHER PUBLICATIONS

Katherine O'Brien, Soft Proofing: Seeing is Believing, Sep. 1, 2004, American Printer.*

* cited by examiner

*Primary Examiner*—Hai C Pham
*Assistant Examiner*—Kainoa B Wright
(74) *Attorney, Agent, or Firm*—Polster, Lieder, Woodruff & Lucchesi, L.C.

(57) ABSTRACT

A method for electronically layering product label designs onto an electronic representation of a digital media storage disc to enable accurate representation of opaque, Pantone, white, and transparent inks on the digital media storage disc background to produce a soft disc print proof.

12 Claims, 4 Drawing Sheets
(3 of 4 Drawing Sheet(s) Filed in Color)

METHOD FOR PRODUCING DISC OVERLAY PROOFS

CROSS-REFERENCE TO RELATED APPLICATIONS

Not Applicable.

STATEMENT REGARDING FEDERALLY SPONSORED RESEARCH

Not Applicable.

BACKGROUND OF THE INVENTION

The present invention is directed generally to a method for producing soft proof images of product labels, and in particular, to a method for electronically layering product label selections onto a representation of a digital media storage disc to enable accurate reproduction of opaque, white, and transparent inks on the disc background.

Digital media storage discs such as compact discs (CDs), digital video discs (DVDs), laser video discs (LVDs) and the like are commonly used to store large quantities of digital data including computer programs, digital image files, audio files, and movies. A conventional digital media storage disc consists of an annular media recording layer embedded within a protective transparent plastic coating. The media recording layer typically consists of a metallic film, having a patterned reflective surface which diffracts incident light across the visible spectrum, often appearing as a rainbow effect to a human observer.

While some digital media storage discs are produced without labeling, it is common to print identifying labels, advertisements, or images onto one surface of the digital media storage disc using conventional printing technology and inks suitable for adhesion to the protective transparent plastic coating of the disc. The inks used in the label print may include opaque inks, Pantone inks, white inks, or transparent inks.

Prior to printing the labels, advertisements, or images onto a surface of the digital media storage disc, a proof or sample of the label artwork is generated to facilitate the layout, design, and layering of the inks. Proofs are commonly generated electronically, and then printed on paper for approval. Each ink color is generated electronically as a separate layer, and may be printed separately as required.

When generating conventional proofs electronically or printing conventional proofs on paper for inspection and approval, the electronic background and paper backgrounds appear white and the digital media storage disc itself is not shown (or shown only in outline form), rendering accurate reproduction of the final appearance of white and transparent inks on a digital media storage disc difficult. Reproductions of the proofs which do not accurately reproduce the appearance of the finished product printed on a digital media storage disc can result in customer dissatisfaction due to unexpected differences between the conventional proof and the printed product on the digital media storage disc. These differences can result in rejection or can require considerable time and expense to change or modify the product to meet customer expectations. An alternative would be to send sample printed discs to the customer for approval, but preparing small quantities of such discs for sample productions needlessly utilizes expensive equipment needed for high-volume production.

Overlay proofs, in which each color is separately printed on transparent sheets which are then overlaid and bound in registration or laminated, are sometimes used.

This type of proof may use a foil background sheet to simulate the metallic appearance of the disc. However, the foil background does not have the diffraction "rainbow" effect and so the appearance does not closely match the actual disc. Also, overlay proofs are expensive to produce because they must be assembled manually after printing each color in the overlay.

Accordingly, it would be advantageous to provide a method by which color accurate proofs may be generated electronically and printed or displayed to provide representations of opaque, Pantone, white, and transparent inks as they would appear when printed on the digital media storage discs.

BRIEF SUMMARY OF THE INVENTION

Briefly stated, the present invention provides a method for layering product label selections onto a representation of a digital media storage disc to enable accurate reproduction of opaque, white, and transparent inks on the disc background.

In a first method of the present invention, a representation of a product label having an opaque ink is initially generated electronically. An electronic representation of a disc background is selected from a set of representative disc backgrounds. The product label representation and disc background representation are layered and flattened to produce a soft proof image of the finished product label on a digital media storage disc.

In an alternate method, a representation of a product label having a white ink is initially generated electronically. An electronic representation of a disc background is selected from a set of representative disc backgrounds. The product label representation is removed from the disc background representation to produce a soft proof image of the finished product label on a digital media storage disc.

In an alternate method, a representation of a product label having transparent ink is initially generated electronically. An electronic representation of a disc background is selected from a set of representative disc backgrounds. The product label representation and disc background representation are layered and blended to produce a soft proof image of the finished product label on a digital media storage disc.

In an alternate method, a representation of a product label having a plurality of inks is initially generated electronically with a separate layer representative of each type of ink included in the label. An electronic representation of a disc background is selected from a set of representative disc backgrounds. The separate layers of the product label representation are discretely overlaid and, depending upon the associated ink type, either combined, removed, or merged with the disc background representation in a predetermined print order to produce a soft proof image of the finished product label on a digital media storage disc.

The foregoing features, and advantages of the invention as well as presently preferred embodiments thereof will become more apparent from the following description in connection with the accompanying drawings.

BRIEF DESCRIPTION OF THE SEVERAL VIEWS OF THE DRAWINGS

The patent or application file contains at least one drawing executed in color. Copies of this patent or patent application publication with color drawing(s) will be provided by the Office upon request and payment of the necessary fee.

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description is to enable one skilled in the art to make and use the invention, and describes several embodiments, adaptations, variations, alternatives, and uses of the invention, including what is presently believed to be the best mode of carrying out the invention.

Figure 1:
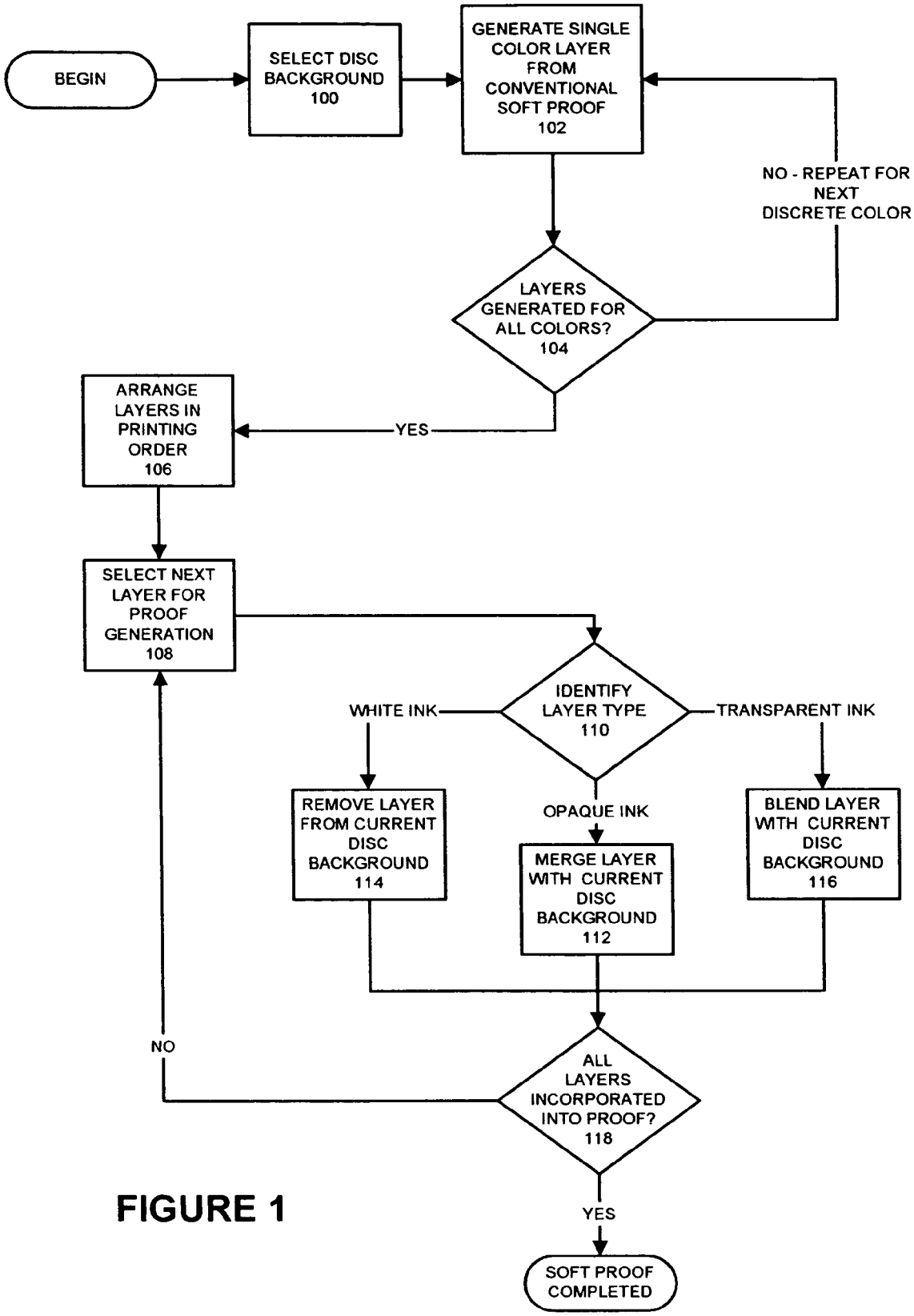
FIG. 1 is a flow chart illustrating the steps in a method of the present invention.

Turning to FIG. 1, a flow chart of a method of the present invention for generating an electronic or soft proof of a digital media storage disc label print is shown generally. The process is preferably implemented as a set of program instructions in a computer or processing system, with user interaction handled through conventional graphical user interfaces and input/output devices. Those of ordinary skill in the art will recognize that all or parts of the process may be implemented using tools or components of commercially available document production and graphics design software packages, such as Adobe Acrobat and Adobe Photoshop available from Adobe Systems Incorporated.

Figure 2:
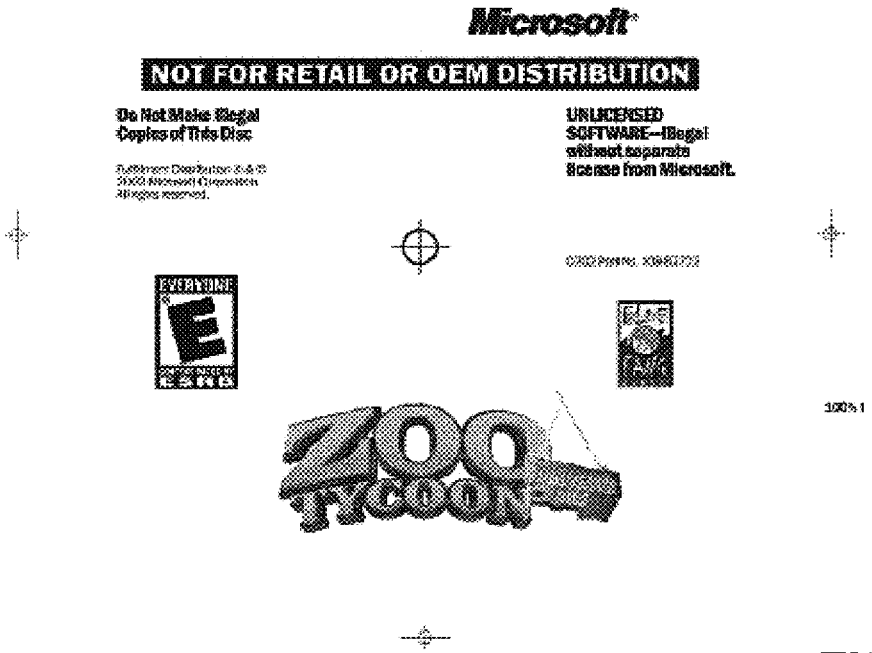
FIGURE 2 Prior Art
FIG. 2 is an illustration of a prior art single opaque color proof layer.
Figure 3:
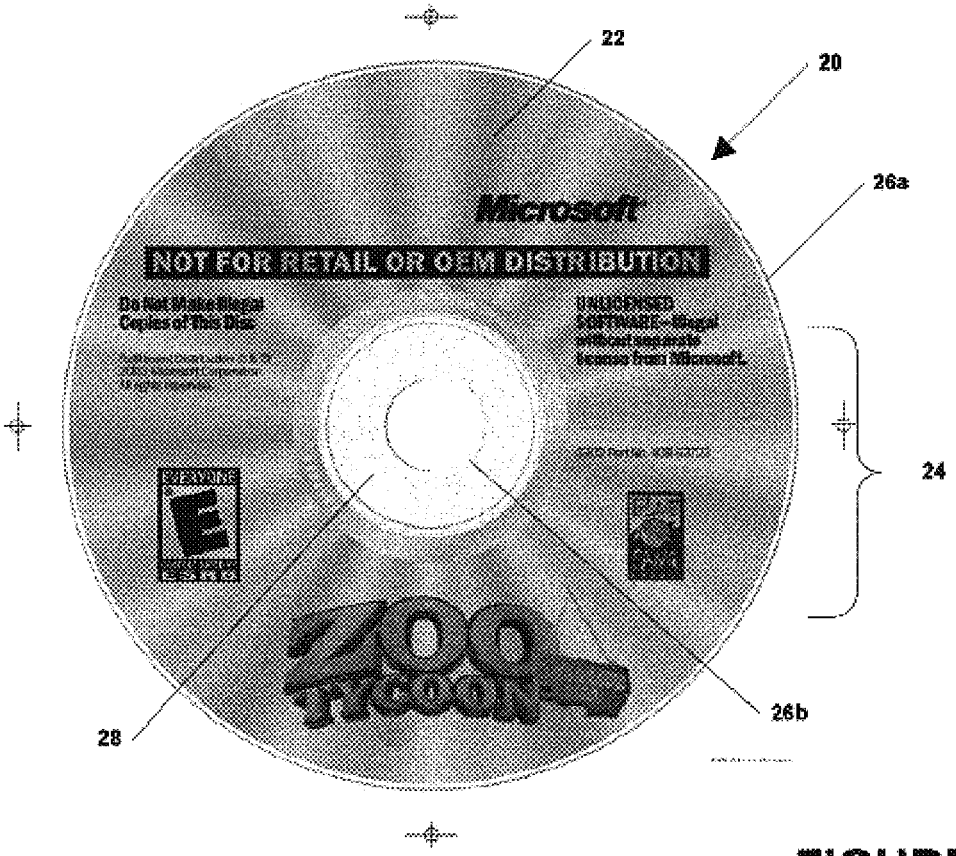
FIG. 3 is an illustration of the proof layer of FIG. 2 merged with a representative disc background.

Once a conventional electronic or soft proof of a disc label is generated, such as shown in FIG. 2, incorporating the desired text, colors, and images for imprinting on a digital media storage disc, the process of the present invention begins with the selection of a representative digital media storage disc background 20 from a library of backgrounds (Box 100). Preferably, the representative disc background 20 is selected to correspond in size and shape to a digital media storage disc onto which a label will eventually be printed, as shown in FIG. 3. To simulate the reflective and light-diffracting appearance of the digital media storage disc, the representative disc background 20 is illustrated or displayed as a silver or gray annular layer 22, incorporating multiple radially-arrayed shades of color arranged in spectral or rainbow sequences 24. The inner and outer circumferential edges 26*a*, 26*b* of the digital media storage disc, together with any transparent annular portions 28 are illustrated or displayed in dimensional relation to the background 20 using conventional lines or shading.

Many different methods can be used for creating disc background images. An actual photograph of a disc can be used, but this technique requires careful lighting in order to produce the rainbow effect repeatedly around the disc so that the disc can be readily distinguished from the label print wherever it is not covered by ink. More controlled results can be obtained by creating the disc image as a drawing using graphics software. The disc background should have a neutral silver-gray color like the metal used in optical disc manufacturing. The addition of subtle rainbows can be accomplished by using gradients created using a blend of primary colors in the visible spectrum. Adobe Photoshop and Adobe Illustrator both provide this capability, for example. A linear gradient with rainbow-like colors can be distorted into the shape of a narrow circular sector. Using transparency to achieve a subdued color effect, the rainbow images thus created are distributed radially around the disc. Disc metal in areas that do not contain recorded information do not produce the rainbow diffraction effect and so can be represented using shading to simulate the actual appearance. Clear plastic areas of the disc and other feature can also be created as required.

An enhancement of the disc background image uses animation to simulate the movement of the diffraction patterns when an actual disc is held in the human hand and tilted to reflect ambient light in a variable manner. In this embodiment, the disc background becomes a video movie rather than a static image. This animated disc overlay representation would not be used for printing but is a new type of soft proof.

Once the representative disc background 20 has been selected (Box 100), the conventional electronic or soft proof of a disc label (FIG. 2) is used to generate a representation of an image layer (Boxes 102) corresponding to each color to be printed onto the surface of the digital media storage disc. For example, FIG. 3 illustrates a single image layer corresponding to a conventional black ink soft proof of FIG. 2 printed onto the representation of the surface of a digital media storage disc. The process is repeated until a representation of an image layer has been generated for each discrete ink shade or color, including opaque inks, white inks, Pantone inks, and transparent inks included in the conventional electronic or soft proof of the disc label print (Box 104).

Once each image layer has been generated, the image layers are sequentially arranged in a desired order of printing (Box 106), corresponding to the particular method of printing which will be used to produce the final images on the digital media storage discs. The first image layer which will be printed is selected (Box 108), and the type of ink associated with the layer is identified (Box 110). To accurately reproduce the appearance of ink printed onto the surface of a digital media storage disc, the method of the present invention alters the representative disc background 20 differently in response to the type of ink associated with each layer.

Figure 4:
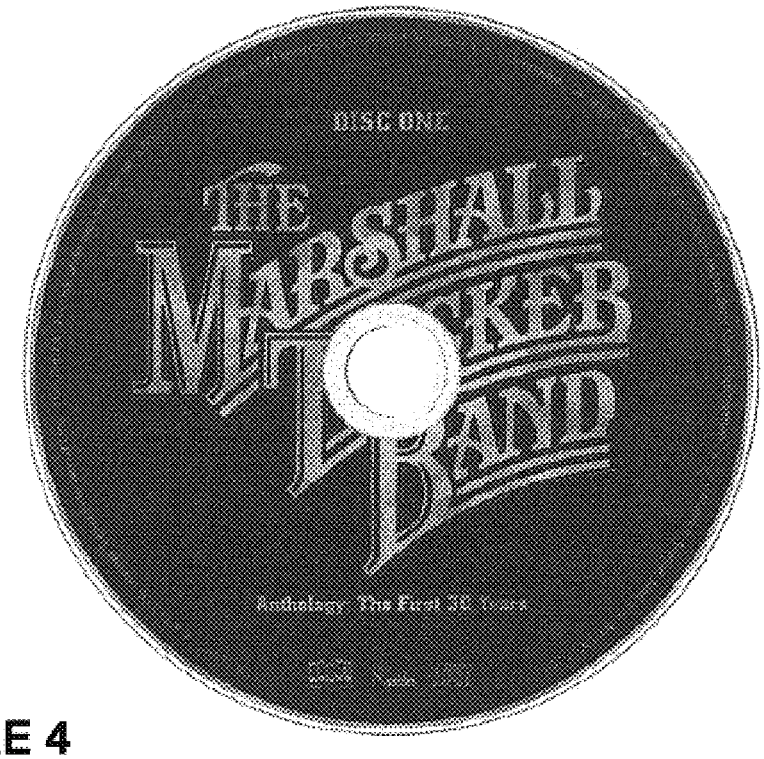
FIG. 4 is a second illustration of an opaque ink layer merged with a representative disc background to produce clear lettering.

Opaque inks, including colored, black and gray inks, are illustrated by overlaying and merging or flattening the associated layer with the current disc background (Box 112). For example, as shown in FIG. 3, the resulting image or soft proof displays the current disc background in areas in which no ink will be printed, and the associated ink layer for areas which are to be printed in the associated opaque ink to produce lettering, images, or designs. Layering of an opaque ink may further be used to produce clear or "cut-out" lettering, images, or designs on the current disc background, as is shown in FIG. 4, in which the current disc background remains visible within the lettering, images, or designs while the remainder of the current disc background is obscured with the opaque ink.

Figure 5:
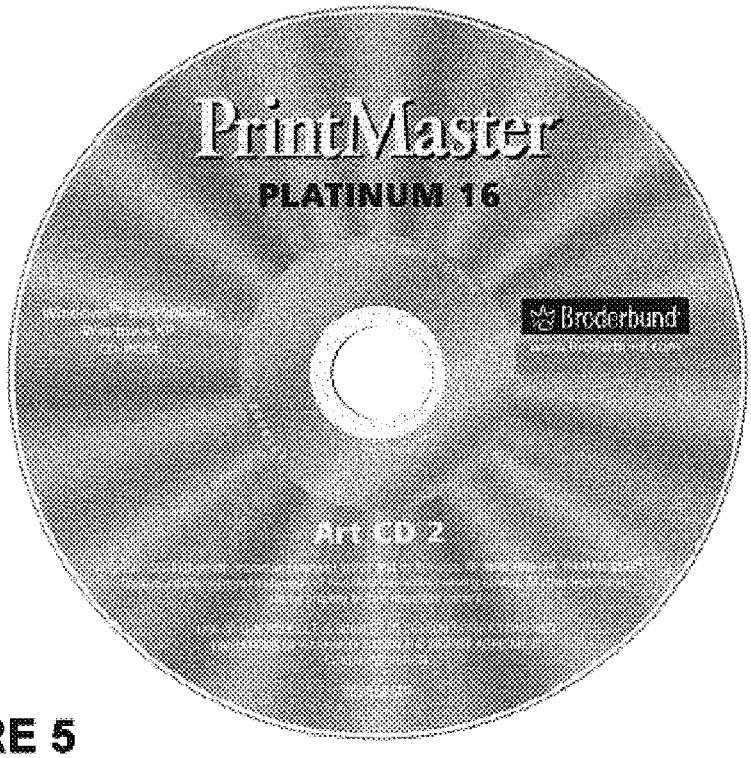
FIG. 5 is an illustration of an opaque ink layer merged with a representative disc background, and a white ink layer removed from the representative disc background.

White inks are illustrated by overlaying and removing the associated areas from the current disc background (Box 114). For example, as shown in FIG. 5, the resulting image or soft proof displays the current disc background, including any already incorporated ink layers, in areas in which no white ink will be printed, and the associated white ink layer for areas which are to be printed in the associated white ink.

Figure 6:
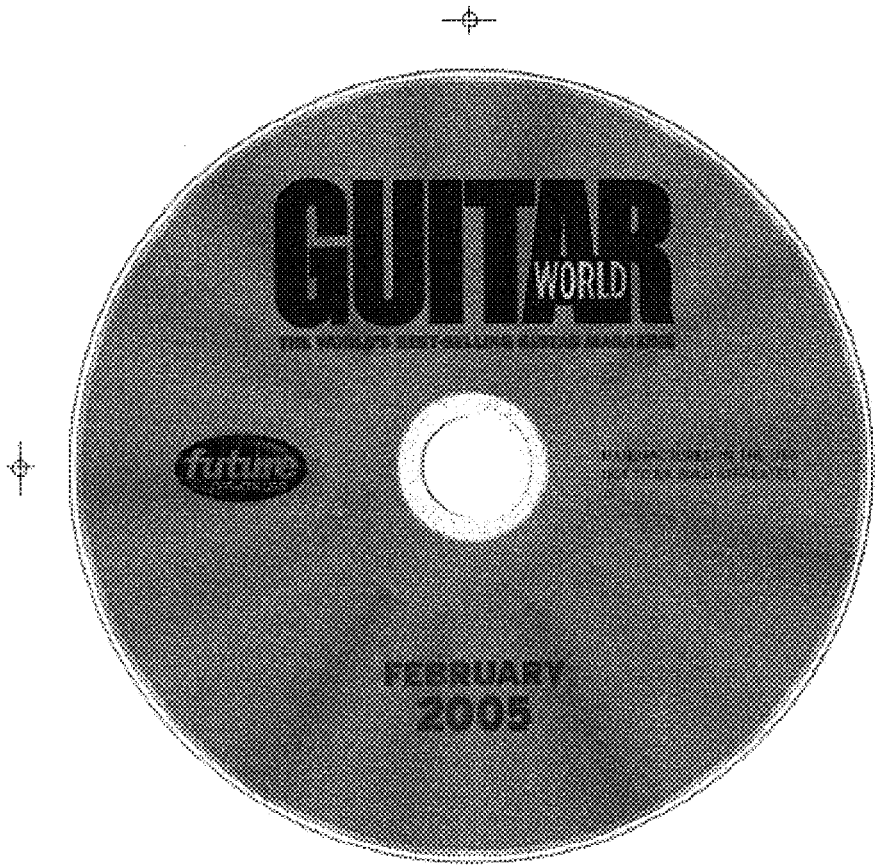
FIG. 6 is an illustration of a transparent ink layer blended with a representative disc background.

Transparent inks are illustrated by overlaying the associated layer with the current disc background and processing the two using a multiply-blend procedure (Box 116). For example, as shown in FIG. 6, the resulting image or soft proof displays the current disc background through areas which are to be printed in the associated transparent ink, multiply-blending the colors and shading present in the current disc background with the transparent ink color or shade. Partial transparency can also be achieved by specifying ink opacity and blending.

As a representation of an ink layer is processed with the current representative disc background 20, the representative disc background 20 changes to include the corresponding ink layer representation, becoming the new current disc background 20 to be used during the processing of the next ink layer. The process is repeated (Box 118) until each ink layer has been processed in accordance with the predetermined printing order. After each ink layer has been processed, the current disc background represents the completed electronic or soft proof of the disc overlay, providing a visually accurate display of the printed appearance of the product, suitable for display on a graphical user interface or for printing.

The visually accurate display or representation of a finished product digital media storage disc with a printed label may then be distributed to a customer, either in printed form, or in electronic form, for customer feedback. The feedback may include a request for changes, or an approval of the representation, after which the representation may then be utilized to produce actual finished digital media storage discs with printed labels.

The present invention can be embodied in-part in the form of computer-implemented processes and apparatuses for practicing those processes. The present invention can also be embodied in-part in the form of computer program code containing instructions embodied in tangible media, such as floppy diskettes, CD-ROMs, hard drives, or an other computer readable storage medium, wherein, when the computer program code is loaded into, and executed by, an electronic device such as a computer, micro-processor or logic circuit, the device becomes an apparatus for practicing the invention.

The present invention can also be embodied in-part in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented in a general-purpose microprocessor, the computer program code segments configure the microprocessor to create specific logic circuits.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

The invention claimed is:

1. A method for producing a representation of a soft proof disc overlay of a printed label on a digital media storage disc, comprising:

generating a printed label soft proof including a representation of at least one ink type;

creating a representative digital media storage disc background image layer, said background image layer including a plurality of color gradients simulating an optical rainbow diffraction effect visible on a surface of a digital media storage disc;

generating an image layer from said generated soft proof for each represented ink type;

overlaying said generated image layer with said disc background image layer;

combining said overlaid image layer with said disc background image layer to modify said selected disc background image layer using a process which is responsive to said represented ink type; and repeating said steps of overlaying and combining for each of said generated image layers, wherein said final disc background image layer represents said soft proof disc overlay on a digital media storage disc.

2. The method of claim 1 wherein said step of generating an image layer includes generating an image layer representing an opaque ink type.

3. The method of claim 1 wherein said step of generating an image layer includes generating an image layer representing a white ink type.

4. The method of claim 1 wherein said step of generating an image layer includes generating an image layer representing a Pantone ink type.

5. The method of claim 1 wherein said step of generating an image layer includes generating an image layer representing a transparent ink.

6. The method of claim 1 wherein said step of generating an image layer includes generating an image layer representing a partially transparent ink.

7. The method of claim 1 wherein said step of combining further includes a process of merging said overlaid image layer with said disc background image layer responsive to an opaque ink type.

8. The method of claim 1 wherein said step of combining further includes a process of removing regions corresponding to said overlaid image layer from said disc background image layer responsive to a white ink type.

9. The method of claim 1 wherein said step of combining further includes a process of blending said overlaid image layer with said disc background image layer responsive to an ink type which is at least partially transparent.

10. A method for marketing a printed label on a digital media storage disc, comprising the steps of:

producing a representation of a digital media storage disc having an overlay according to the method of claim 1;

transmitting the representation to at least one customer; and receiving feedback associated with said representation from said at least one customer;

producing and selling a product utilizing said received feedback and said representation.

11. The method of claim 10 wherein said received feedback includes at least one product order for a digital media storage disc having a printed label.

12. The method of claim 1 for producing a representation of a soft proof disc overlay of a printed label on a digital media storage disc, further including the step of animating said digital media storage disc background image layer, said animation simulating apparent movement of optical diffraction patterns about a digital media storage disc surface during tilting movement there of.

* * * * *